US005586647A

United States Patent [19]

Barta et al.

[11] Patent Number: 5,586,647

[45] Date of Patent: Dec. 24, 1996

[54] DRINKING GLASS

[76] Inventors: Patrick J. Barta; Ann L. Porterfield, both of 7336 Earl Ave. NW., Seattle, Wash. 98117

[21] Appl. No.: 543,147

[22] Filed: Oct. 13, 1995

Related U.S. Application Data

[63] Continuation of Ser. No. 215,029, Mar. 21, 1994, abandoned.

[51] Int. Cl.[6] ..... B65D 77/00; B65D 25/24; B67B 7/44

[52] U.S. Cl. ..... 206/217; 220/475; 220/629; 81/3.15; 206/426

[58] Field of Search ..... 206/217, 426; 215/99.5; 220/484, 475, 629, 631; 81/3.09, 3.15

[56] References Cited

U.S. PATENT DOCUMENTS

| | | | |
|---|---|---|---|
| 1,814,895 | 7/1931 | Charbonneau | 81/3.15 |
| 2,098,832 | 11/1937 | Payson | 220/475 |
| 2,372,073 | 3/1945 | Flournoy | 220/475 |
| 2,482,278 | 9/1949 | Koerner | 220/475 |
| 3,089,605 | 5/1963 | Buonauro | 215/99.5 |
| 3,369,687 | 2/1968 | Walls | 215/99.5 |
| 4,436,214 | 3/1984 | Henderson | 220/475 |
| 5,014,865 | 5/1991 | Sauber | 215/99.5 |

FOREIGN PATENT DOCUMENTS

| | | | |
|---|---|---|---|
| 85879 | 5/1956 | Denmark | 215/99.5 |
| 993493 | 10/1951 | France | 215/99.5 |
| 3839400 | 5/1990 | Germany | 215/99.5 |

*Primary Examiner*—Marie D. Patterson

[57] ABSTRACT

A drinking glass having a cup portion, a stem attached to the cup and upon which the cup is supported, and a detachable base engageable with the stem in two distinct alternative base positions. The base is capable of securely maintaining the drinking glass at rest in an upright orientation in at least one of the base positions on a range of support surfaces. The range of support surfaces suitably includes a hard even surface and a penetrable uneven surface. In one embodiment, the base is in an upright position and the drinking glass is maintained in an upright orientation on a reasonably flat surface by means of a flange. In this upright base position the base engages with the stem via mating engagement of a spike in a hollow interior of the stem. If the spike is withdrawn and the base inverted to the alternative inverted base position, the stem can be engaged with the base via mating engagement with a socket provided in the underside of the base, such that the spike extends downwards and may be securely penetrated in penetrable media to maintain the drinking glass in upright orientation on an uneven surface. A second embodiment replaces the spike with a corkscrew so that the detachable base can also be used as a handle for a corkscrew.

7 Claims, 3 Drawing Sheets

DRINKING GLASS

This application is a continuation, of application Ser. No. 08/215,029, filed Mar. 21, 1994 now abandoned.

BACKGROUND OF THE INVENTION

Picnics and other outdoor meals are favorite summertime activities for many people. Such meals are often enjoyed away from areas providing picnic tables. At these times the meal is typically served on a table cloth or blanket lain on the grass covered ground. Those enjoying picnics in this way typically have no problem holding the plates on which their meal has been served. Unfortunately, it is difficult to maintain a glass upright at these times. If the glasses provided are wineglasses they are often too unstable when filled to balance properly and remain upright when set down by the user. Furthermore, such glasses are often quite delicate and are prone to breakage when being transported or if tipped. Nevertheless, wineglasses do remain the glass of choice for many wine drinkers and others insisting on an element of class, even during outdoor meals.

For this reason there is a need for a wineglass or drinking glass that is usable in outdoor environments that eliminates the inherent instability of the traditional wineglass. There is also a need for such a drinking glass to be of a durable construction that eliminates the possibility of breakage during transport and if possibly dropped or tipped. There is a further need for such a drinking glass to be stylish and simple in use.

SUMMARY OF THE INVENTION

The present invention is drawn to a drinking glass that satisfies the aforementioned need for a drinking glass that has the stability and durability necessary for outdoor use. The drinking glass is also elegant in design and easily used.

The drinking glass comprises a cup, a stem upon which the cup is supported, and a detachable base that is engageable with the stem in two positions. The two distinct base positions are an upright base position and also a position in which the base has been inverted. Additional features of the drinking glass include a base that includes a spike that extends into the stem when the base is upright and is resiliently attached to the stem. The base if used in the upright position provides the drinking glass with the appearance of a typical wineglass as the base has a flange for providing support to the entire glass. The base upon being disengaged from the stem and inverted exposes a socket that has an interior surface for mating engagement with the stem exterior surface. A friction fit retains the stem within the socket once inserted.

The base, once detached from the stem and rotated into the inverted position, also exposes the spike. In this position the spike may be inserted into a penetrable medium such as the ground. The base may be maintained in the penetrable medium awaiting insertion of the stem in the socket, thereby maintaining the drinking glass in an upright position. Alternatively, the base once inverted may be attached to the stem. In this condition the entire glass acts as a unitary member that has a spike extending downwardly to penetrate into the ground.

The spike may be of at least two distinct forms. The spike could be that of a simple prong having a cylindrical body and a sharp. Alternatively, the spike may be in the form of a cork screw. In this embodiment the spike has a dual usage.

The drinking glass of the present invention offers several advantages to the user. The drinking glass typically has the shape of standard wineglass and would provide an element of class to the consumption of wine or any other beverage. The drinking glass allows the user to securely keep the glass upright when outdoors. Thus, spilling or breakage caused by tipping can be eliminated. The drinking glass is a durable construction yet is inexpensive to manufacture. The drinking glass is also quite elegant in its simplicity. The detachment of the base requires very little effort even though the base is securely attached to the stem. Once detached, the base in rotated into the inverted position where reattachment with the stem is also easily achieved. The spike permits simple penetration into the ground in either embodiment. The inclusion of a cork screw spike provides the drinking glass with the means to open a wine bottle, as well.

These and other features, aspects, and advantages of the present invention will become better understood with reference to the following drawings, description and appended claims.

DETAILED DESCRIPTION OF THE INVENTION

Figure 1:
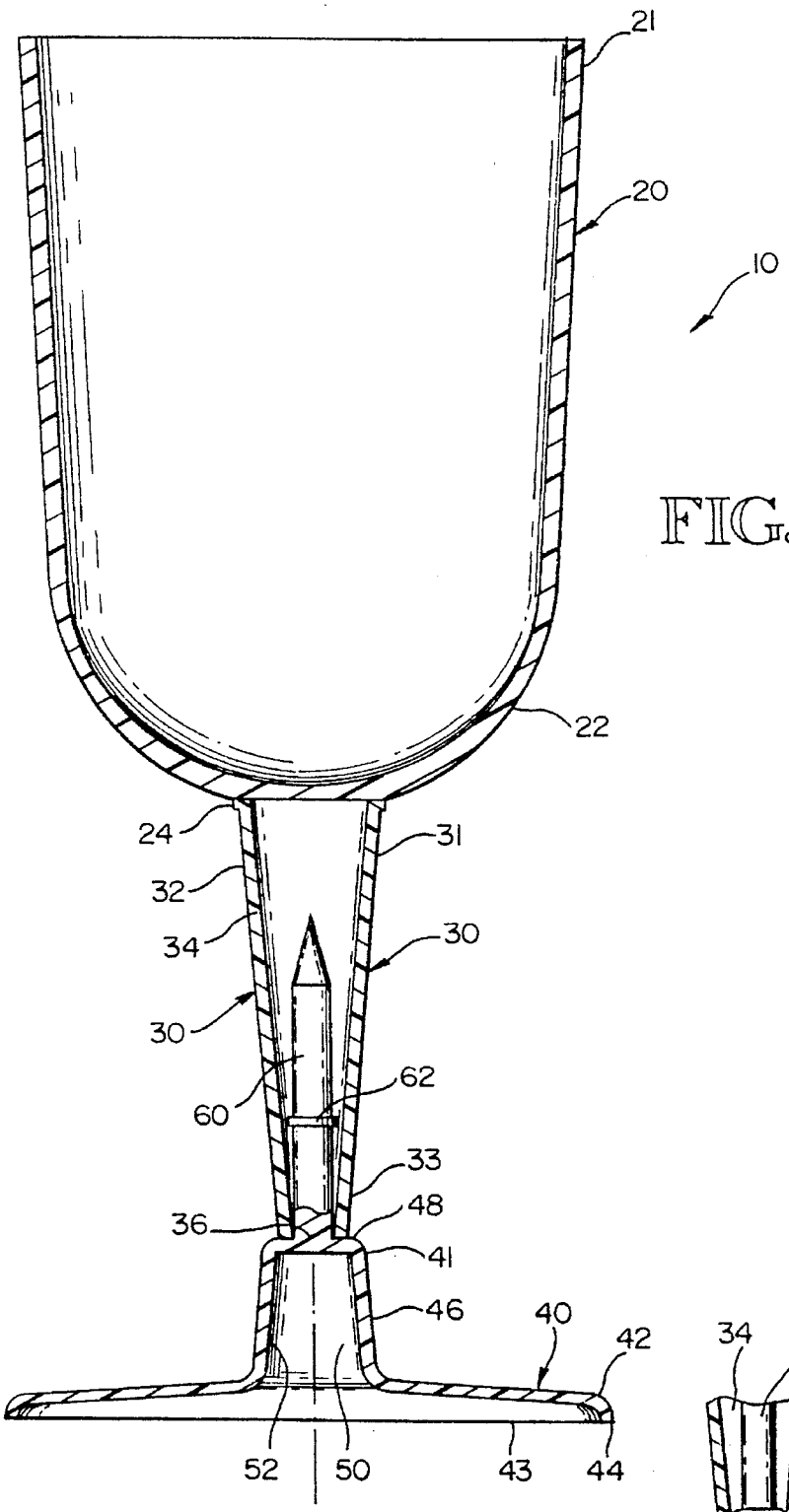
FIG. 1 is a side view of a version of the present invention showing selected elements in partial cross-section.

FIG. 1 shows a version of the drinking glass of the present invention. The drinking glass 10 comprises a cup 20, a stem 30, on which the cup is supported, and a base 40 that includes a spike 60. In the version of the present invention shown in FIG. 1, the cup 20 is similar in shape to the cup of a typical wineglass. More specifically, the cup 20 of the version of the invention shown in FIG. 1 comprises a bowl shaped container having a depth greater than the diameter measure across the top of the bowl. As shown in FIG. 1 the cup has no ornamentation. Alternative designs for the cup 20 could include varied shapes, sizes or the inclusion of ornamentation on the cup 20.

Also shown in FIG. 1 is stem 30 attached to the cup 20. The cup 20 includes an upper portion 21 and a lower portion 22, the stem 30 being attached to the bottom of the cup 20 at the lower portion 22 of the cup 20. Stem 30 comprises a truncated cone that has been inverted. The stem includes a upstanding wall 32 enclosing a hollow interior 34. The upstanding wall 32 tapers from a larger diameter end, at the top portion 31 of the stem 30, that attaches to the cup to a smaller diameter end at the bottom portion 33 of the stem 30 that is disposed away from the cup. The attachment of the stem to the cup may be accomplished in several ways. The version of the invention as shown in FIG. 1 shows the cup having a lip 24 providing an attachment surface for the stem. The attachment may comprise a snap fit connection between the stem and cup or a bonded connection utilizing adhesives. Alternatively, the stem may be integrally manufactured with the cup.

Figure 1A:
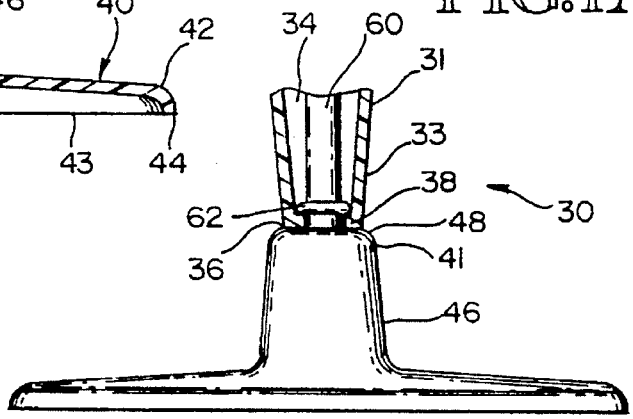
FIG. 1A is a partial side view showing the details of the stem to base connection in a version of the present invention.

The smaller diameter end of the stem provides an orifice or opening into which may be inserted the spike 60 of the base 40. FIG. 1A shows a version of the snap fit or resilient connection between the spike 60 and the stem 30. In this embodiment the opening at the smaller diameter end 36 of the stem 30 includes an inwardly extending annular lip 38. The lip 38 is sized to permit a spike having a corresponding annular protuberance 62 to resiliently spread the lip to pass into the hollow interior 34 of the stem. Once the annular protuberance 62 has been inserted into the hollow interior a sufficient amount the annular lip 38 is permitted to resiliently constrict the opening to the original size. The annular lip in this position abuts against the spike and the smaller end 36 of the stem is abutted against the base 40. The snap fit connection between the stem and the base as shown in FIG. 1A and herein described is exemplary of a typical snap lit connection that may be utilized. Other embodiments of snap fit connections that are well known could also be utilized.

Figure 3:
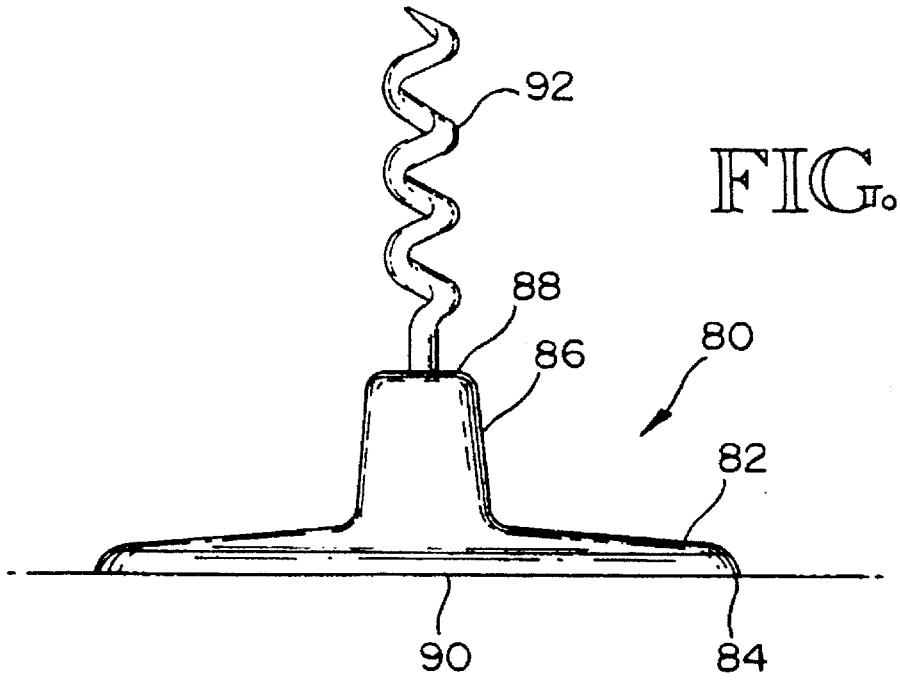
FIG. 3 is a side view showing a second embodiment of the base of the present invention.

Also shown in FIG. 1 is base 40 includes a first end 41 and a second end 43 and base 40 typically comprises a pedestal 46 having a top surface or platform 48 at the first end 41 of the base 40 and a flange 42 extending outwardly from the pedestal. The pedestal 46 includes an upright wall enclosing a hollow interior or socket 50. The pedestal of the version of the invention shown in FIG. 1 has the shape of a truncated cone. The pedestal includes a top surface or platform 48 from which extends a spike 60. The platform 48 also provides a surface upon which the smaller diameter end of the stem abuts. Spike 60 generally extends orthogonally from the platform 48 for insertion into the stem 30. The spike of the version of the present invention disclosed in FIG. 1 has the shape of a prong having an elongated cylindrical body and a sharp tip. FIG. 3 shows another embodiment of the base having a spike comprising a cork screw 92 having a helical shape and a sharp tip.

The base further includes a flange 42 disposed around the pedestal 46 that provides support to maintain the drinking glass in an upright position. The flange is bordered by a supporting lip 44 at the second end 43 of the base 40 thereby maintaining the flange 42 at a spaced relation to the surface upon which the drinking glass is placed. The flange 42 is generally circular in shape and is disposed with a slight decline from the upright wall of the pedestal 46 to the supporting lip 44.

Figure 2:
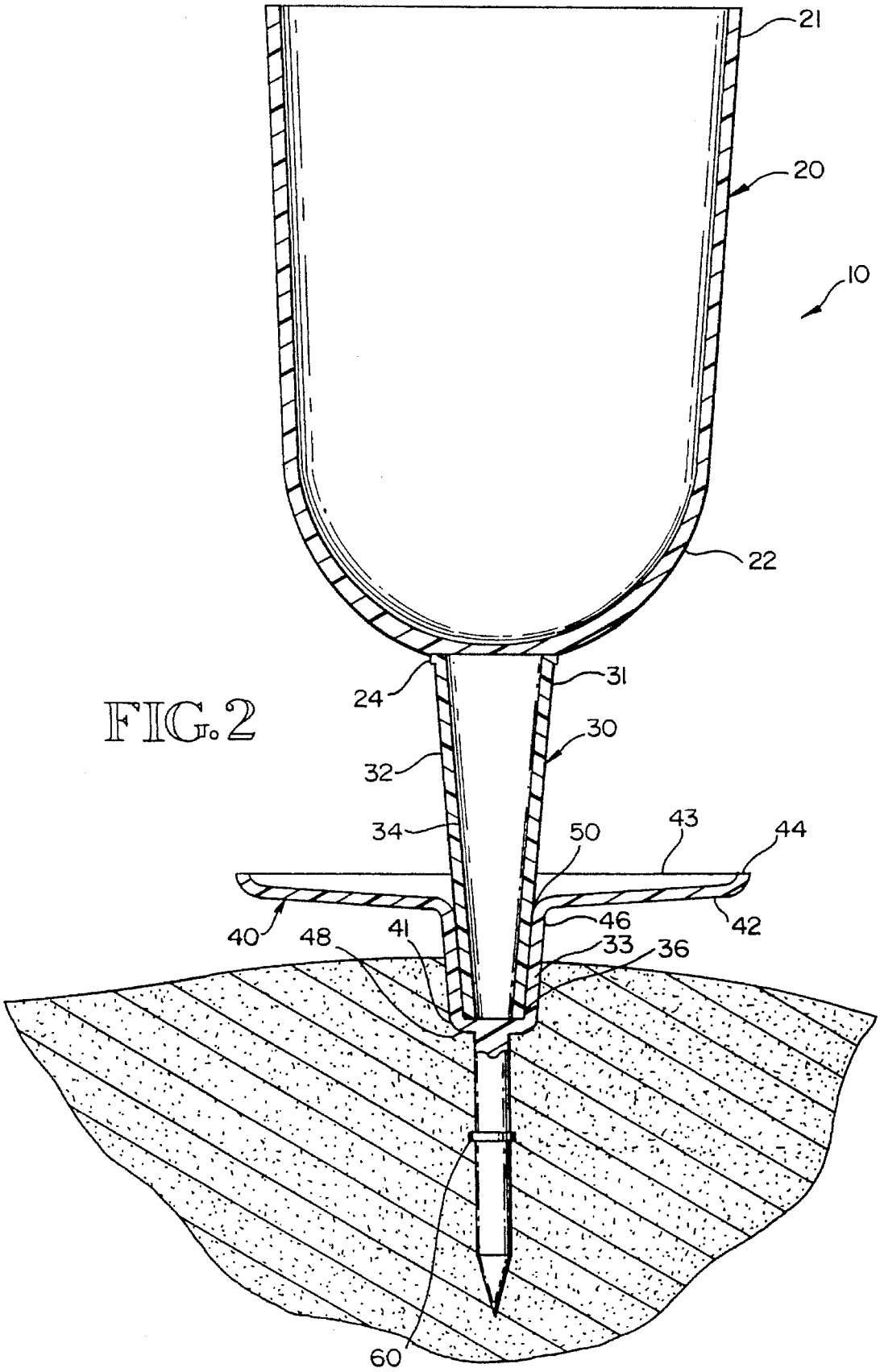
FIG. 2 is a side view of a version of the present invention as shown in FIG. 1 showing selected elements in partial cross-section. The view includes the base of the drinking glass in the inverted position.

As shown in FIGS. 1 and 2 the pedestal 46 of the base 40 includes a hollow interior or socket 50. The socket 50 is disposed within the underside of the base and is exposed once the base is inverted. The socket 50 is enclosed partially by the underside of the platform 48 and by the upright wall of the pedestal 46. The interior surface 52 of the socket, as shown in FIG. 2, corresponds with the exterior surface of the stem upright wall 32. The socket 50 is able to retain the stem 30 once inserted into the socket 50 by a friction fit between the stem upright wall 32 and the interior surface 52 of the socket. In this fully inserted position, the smaller diameter end 36 of the stem 30 extends into the socket to abut against the underside of the platform 48.

The present invention provides an easy to use drinking glass that is appropriate for the outdoors. The drinking glass is easily converted from the orientation as shown in FIG. 1 with the base in an upright position to the orientation of FIG. 2 with the base in an inverted position. The snap fit of the base within the stem, as shown in FIG. 1A, although secure, allows an easy detachment of the base. Once the base 40 has been detached from the stem the base can be utilized in two ways. The base 40 at this time can be inverted and secured to the ground by placing the spike 60 into the ground. In this position the socket 50 is available to receive the stem 30 to be inserted and thus, maintain the glass in an upright position. Alternatively, the base 40 once inverted may be attached to the stem by inserting the stem 30 into the socket 50. In this position the entire drinking glass 10 may be used as a complete assembly, and by secured in the ground by penetrating the spike into the ground. The cup 20 may then be used by detaching the stem from the base that has been secured in the ground, or alternatively by releasing the base 40 from the ground while maintaining the attachment of the stem 30 within socket 50. The drinking glass 10 can, of course, be utilized as a typical drinking glass while the base is in the upright position.

The use of base 80 as shown in FIG. 3 does not vary from the base of FIGS. 1 and 2. The base 80 offers the additional feature of a cork screw 92 as the spike. The cork screw once removed from the stem 30 would provide a means to remove the cork of a wine bottle. The flange 82 serves as a handle for the cork screw 92.

The drinking glass of the present invention may be manufactured from a variety of available materials including plastics, glass, or metal. The drinking glass may also be manufactured in a variety of shapes, sizes, and colors. Furthermore, the drinking glass may include ornamentation. As such, a stem having flutes could easily be accommodated by the present invention. The details of the resilient connection between the stem and the base also could be modified to include any of the well known snap fit resilient connections that currently exist.

The drinking glass offers many advantages. The drinking glass has a stylish wineglass shape so that it provides an clement of class to the consumption of wine or other beverages. The drinking glass is durable and is unlikely to break during transport or if tipped. Furthermore, the drinking glass offers users the ability to consume beverages out of doors with a product that is inexpensive and very easy to use.

Although the present invention has been described with respect to a preferred embodiment and a variation thereof, it is understood that it is not to be so limited since changes and modifications can be made therein which are within the intended scope of this invention as defined by the appended claims.

I claim:

1. A drinking glass comprising:

a cup having an upper portion and a lower portion;

a stem having a top portion and a bottom portion, the top portion of the stem attached to the lower portion of the cup;

a base having a first and second ends;

means for inverting and detaching the base from the stem, associated with the base, for removably attaching the first end of the base to the bottom portion of the stem in a first position and for removably attaching the second end of the base to the bottom portion of the stem in a second inverted position;

means for securely inserting the base into a penetrable medium attached to the second end of the base wherein the means for securely inserting the base into a penetrable medium includes a spike and wherein the stem includes an upright wall surrounding a hollow interior, the spike fitting into the hollow interior of the stem when the base is in the first position.

2. The drinking glass of claim 1 wherein the means for inverting and detaching the base includes an underside, and the stem has an external surface, the base upon being removed from the stem may be inverted exposing a socket disposed in the underside of the base, the socket having an interior surface for mating engagement with the external surface of the stem allowing insertion of the stem into the socket, and wherein the means for inverting and detaching the base additionally includes a spike disposed on the base in opposition to the socket.

3. The drinking glass of claim 2 wherein as the means for inverting and detaching the base places the base in the second inverted position the spike may be securely penetrated into a penetrable medium to permit retaining the drinking glass in an upright position.

4. The drinking glass of claim 3 wherein the spike has a prong shape having a cylindrical body with a sharp tip.

5. The drinking glass of claim 1 wherein the means for inverting and detaching the base includes a flange for providing support to the drinking glass while the base is maintained in the first upright position.

6. The drinking glass of claim 1 wherein a resilient connection holds the spike and the stem removably together while the spike is inserted into the stem.

7. A drinking glass comprising:

A cup having an upper portion and a lower portion;

A stem having a top portion and a bottom portion, the top portion of the stem attached to the lower portion of the cup;

A base having a first and second ends;

means for inverting and detaching the base from the stem, associated with the base, for removably attaching the first end of the base to the bottom portion of the stem in a first position and for removably attaching the second end of the base to the bottom portion of the stem in a second inverted position; wherein the means for inverting and detaching the base includes an underside, and the stem has an external surface, the base upon being removed from the stem may be inverted exposing a socket disposed in the underside of the base, the socket having an interior surface for mating engagement with the external surface of the stem allowing insertion of the stem into the socket; wherein the means for inverting and detaching the base additionally includes a spike disposed on the base in opposition to the socket; wherein as the means for inverting and detaching the base places the base in the second inverted position, the spike may be securely penetrated into a penetrable medium to permit retaining the drinking glass in an upright position; and wherein the spike is in the shape of a cork screw having a helical body with a sharp tip.

* * * * *